US011576443B1

(12) United States Patent
Carnegie

(10) Patent No.: US 11,576,443 B1
(45) Date of Patent: Feb. 14, 2023

(54) PAJAMA PANTS SLEEPWEAR

(71) Applicant: Lavern V. Carnegie, Washington, DC (US)

(72) Inventor: Lavern V. Carnegie, Washington, DC (US)

( * ) Notice: Subject to any disclaimer, the term of this patent is extended or adjusted under 35 U.S.C. 154(b) by 0 days.

(21) Appl. No.: 15/954,659

(22) Filed: Apr. 17, 2018

Related U.S. Application Data

(60) Provisional application No. 62/486,280, filed on Apr. 17, 2017.

(51) Int. Cl.
*A41D 1/06* (2006.01)
*A41D 10/00* (2006.01)

(52) U.S. Cl.
CPC ..... *A41D 1/065* (2013.01); *A41D 10/00* (2013.01)

(58) Field of Classification Search
CPC ..... A41D 1/065; A41D 10/00; A41D 13/129; A41D 2400/44; A41D 1/06; A41B 9/007; A41B 9/005; A41B 9/04
USPC ..... 2/78.2, 227
See application file for complete search history.

(56) References Cited

U.S. PATENT DOCUMENTS 676,336 A * 6/1901 McGuire ..... A41B 9/04 2/408
1,110,053 A * 9/1914 Hatch ..... A41B 9/08 2/78.2
1,469,287 A * 10/1923 Torchia ..... A41B 9/005 2/408
1,861,383 A * 5/1932 Ficcio ..... A41D 1/06 2/227
2,334,144 A * 11/1943 Bono ..... A41D 1/21 2/235
3,088,116 A * 5/1963 Simonoff ..... A41D 13/02 2/77
3,246,342 A * 4/1966 Pagano ..... A41D 1/06 2/227
3,496,572 A 2/1970 Herzig
4,389,733 A * 6/1983 Boykins, Jr. ..... A41D 1/08 2/466
4,446,575 A * 5/1984 Davis ..... A41D 13/1254 2/400

(Continued)

FOREIGN PATENT DOCUMENTS

CH 505576 A 4/1971
EP 0242440 10/1987

(Continued)

*Primary Examiner* — Clinton T Ostrup
*Assistant Examiner* — Brieanna Szafran
(74) *Attorney, Agent, or Firm* — Blank Rome LLP

(57) ABSTRACT

Pajama wear, in the form of pants or shorts, with an easy accessed, manipulated and released covered front flap-opening for males with urinary urgency or incontinence and or impaired hand co-ordination or physical challenge. This U-shaped flap extending from immediately below the waistband to the crotch, when unfastened, falls downward to allow quick and convenient access to the male genitalia to allow for, but not limited to, urination into a hand-held urinal or a commode. A convenient access for patients and caregivers this route may also be implemented to facilitate urine collection via a hand held urinal, as well as but not limited to, catheter insertion, use care and removal and allowing for medical inspection of the genital area.

22 Claims, 4 Drawing Sheets

(56) References Cited

U.S. PATENT DOCUMENTS

| | | | | | |
|---|---|---|---|---|---|
| 4,604,761 | A * | 8/1986 | Wright | A41D 1/06 | 2/227 |
| 4,677,696 | A | 7/1987 | Tanaka | | |
| 4,856,113 | A | 8/1989 | Moscatelli | | |
| 5,163,184 | A * | 11/1992 | Reardon | A41D 1/06 | 2/218 |
| 5,341,515 | A * | 8/1994 | Cohen | A41D 13/1254 | 2/400 |
| 5,535,452 | A * | 7/1996 | Rozenblat | A41B 9/02 | 2/403 |
| D378,317 | S * | 3/1997 | Wike | D2/712 | |
| 5,867,825 | A | 2/1999 | Scheerer | | |
| 5,926,851 | A * | 7/1999 | Kovalik | A41D 1/06 | 2/114 |
| 7,100,214 | B1 * | 9/2006 | Murray | A41C 1/003 | 2/406 |
| D603,582 | S * | 11/2009 | Fennell | D2/712 | |
| 8,087,098 | B2 * | 1/2012 | Kimberly | A41B 9/001 | 2/227 |
| 8,555,422 | B2 * | 10/2013 | Steele | A41B 9/023 | 2/400 |
| 9,125,440 | B1 * | 9/2015 | Guerrero | A41D 1/06 | |
| 9,532,614 | B2 | 1/2017 | Vanneste | | |
| D802,254 | S | 11/2017 | Morrison | | |
| D839,542 | S * | 2/2019 | Strange | D2/742 | |
| 10,687,570 | B2 * | 6/2020 | Strange | A41D 1/06 | |
| 2005/0144695 | A1 | 7/2005 | Aldridge et al. | | |
| 2006/0107442 | A1 * | 5/2006 | Langmyr | A41D 13/02 | 2/227 |
| 2006/0191059 | A1 * | 8/2006 | Smith | A41B 9/001 | 2/400 |
| 2006/0277667 | A1 | 12/2006 | Plut | | |
| 2007/0192947 | A1 | 8/2007 | Plut et al. | | |
| 2010/0219368 | A1 * | 9/2010 | Srinivasan | D06M 23/08 | 252/8.63 |
| 2014/0047619 | A1 * | 2/2014 | Singh | A41D 1/089 | 2/235 |
| 2014/0230130 | A1 * | 8/2014 | Edwards | A41D 1/065 | 2/227 |
| 2017/0099887 | A1 * | 4/2017 | Boillat-Macon | A41D 13/1254 | |
| 2017/0135875 | A1 * | 5/2017 | Johnson | A41B 9/02 | |

FOREIGN PATENT DOCUMENTS

| | | | |
|---|---|---|---|
| FR | 2810855 | A1 | 1/2002 |
| GB | 1208284 | | 10/1970 |
| WO | WO-2004/105524 | A1 | 12/2004 |

* cited by examiner

FIG. 4
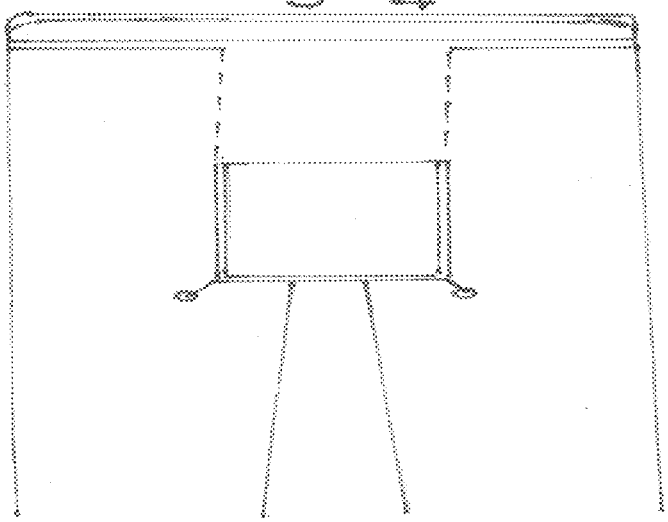
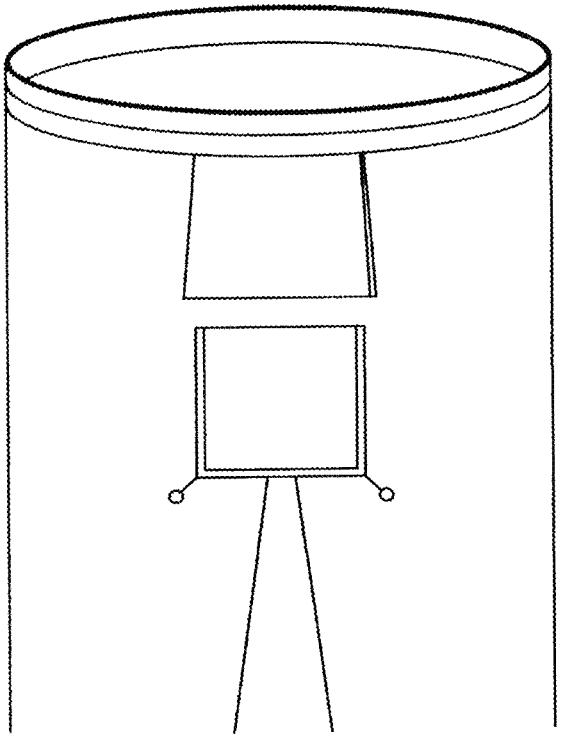
FIG. 5

PAJAMA PANTS SLEEPWEAR

RELATED APPLICATIONS

This application claims the benefit of U.S. Provisional Application No. 62/486,280, filed Apr. 17, 2017, the entire contents of which are incorporated herein by reference.

BACKGROUND OF THE INVENTION

Field of the Invention

The invention relates to pajama wear or pants that provide a quick, easy and convenient opening to expedite the ability to undo the opening of pajamas or pants for males, under conditions of urinary or personal urgency due to clinical conditions, personal convenience or clinical procedural needs.

Background of the Related Art

Urinary urgency or incontinence requires quick access to the male genitalia for the standard process of urination. The slit opening of conventional pajamas or pants, such as shown in FIG. 1, and the nature of these clinical conditions, make undoing the opening in a timely manner difficult and inconvenient. Individuals with impaired hand co-ordination due to clinical or physical conditions and those who are not fully mobile, also find difficulty in manipulating slit openings in a timely manner. These slotted openings also impart difficulty for individuals and patients who are not fully mobile. The opening in these slots are also not very wide and so access to the male genital is problematic under the above circumstances. Standard use of a hand-held urinal or for urine collection is made difficult under the above conditions as well. Insertion, use, care or removal of a catheter as well as examination or observation of the genital and genital area, is made difficult with a slotted opening and so the traditional pants have to be fully removed.

Medical gowns are not always supportive of a patient's pride as they often leave the patient physically exposed. Double gowning is cumbersome and inconvenient when urgent access to the male genitalia is required. For the sake of pride, dignity, institutional location or dwelling, an individual or patient will choose to wear pajama pants or need to wear pajama pants or pants instead of a medical gown.

SUMMARY OF THE INVENTION

Thus, existing solutions do not address the need for easy and quick access to the male genital for individuals with urinary urgency or urinary incontinence and/or hand co-ordination limitations. It is one object of the present invention to address the need for an easily manipulated opening on a pair of pajama pants that will take into consideration, hand co-ordination limitations and timeliness in expediting access and ease of access for the caregiver. It is a further object of the invention to address the ease of closure of this opening.

These and other objects of the invention, as well as many of the intended advantages thereof, will become more readily apparent when reference is made to the following description, taken in conjunction with the accompanying drawings.

BRIEF DESCRIPTION OF THE FIGURES

FIG. 4 is a front view of the front flap-opening of FIG. 2 in the open position;

FIG. 5 is a front view of the front flap-opening of FIG. 3 in the open position with extended cover from the waistband.

DETAILED DESCRIPTION OF THE PREFERRED EMBODIMENTS

Figure 1:
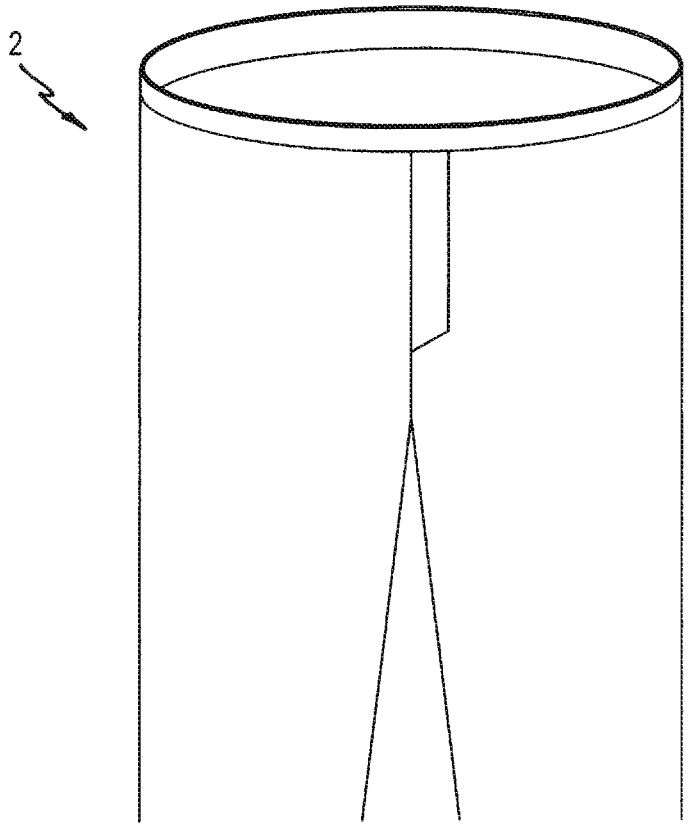
FIG. 1 (PRIOR ART)
FIG. 1 is a front view of prior art pajama pants having a slit opening such as a zipper.

In describing the illustrative, non-limiting preferred embodiments of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several preferred embodiments of the invention are described for illustrative purposes, it being understood that the invention may be embodied in other forms not specifically shown in the drawings.

Figure 2:
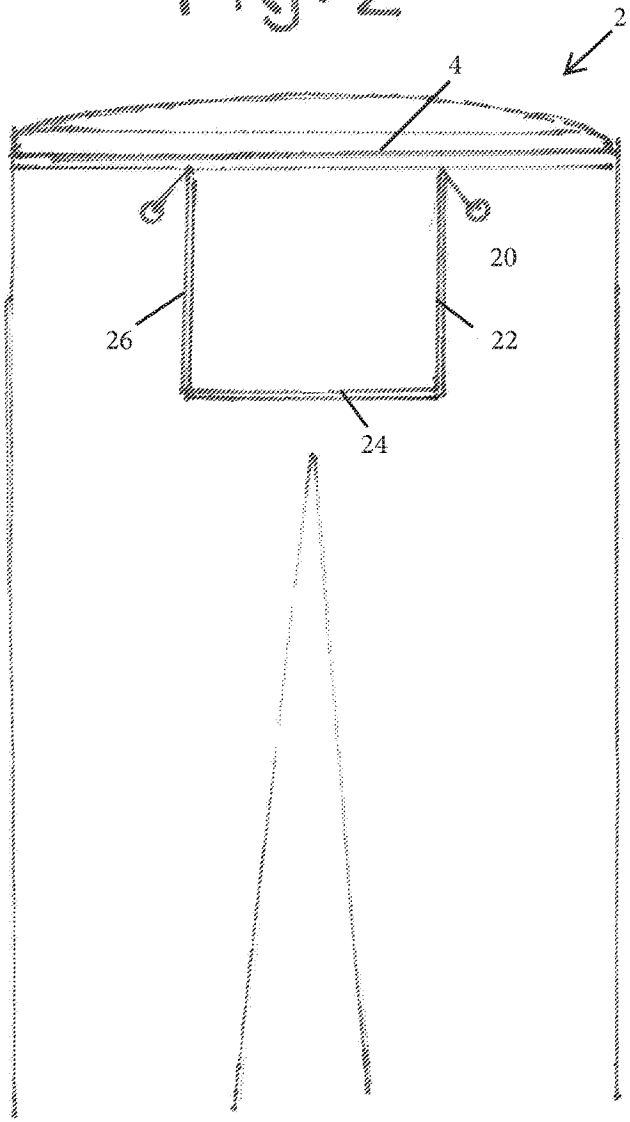
FIG. 2 is a front view of the front flap-opening in the closed position, located immediately below waistband and with pull rings.

Turning to the drawings, FIG. 2 shows an access assembly 5 in accordance with one example embodiment of the invention. The access assembly 5 is shown formed in a garment 2, and particularly in the front top center portion of the garment in the area surrounding the genitals of the user. The garment can be, for example a pajama bottom or pants, and is elongated to define a longitudinal axis, which is vertical in the embodiment of FIG. 2. The garment 2 can have a waistband, such as an elastic band or a non-elastic device such as a string or rope.

Figure 3:
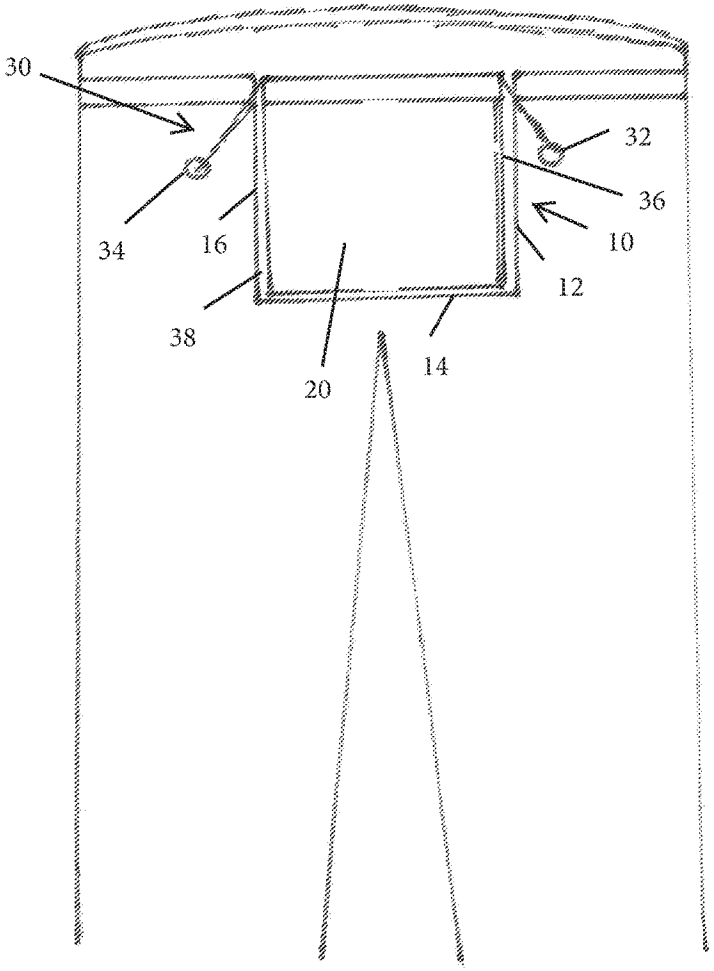
FIG. 3 is a front view of the front flap-opening in the closed position, located at the waistband and with pull rings.

The access assembly 5 generally includes a flap 20, opening 10, and release or engagement devices 30. The flap 20 can have a generally square or rectangular shape with two linear sides or side edges 22, 26 and a linear bottom, bottom side or bottom edge 24. The first and second sides 22, 26 extend substantially parallel to the longitudinal axis of the garment, and the bottom 24 extends substantially orthogonal to the longitudinal axis of the garment and to the two sides or side edges 22, 26. The flap 20 also has atop or top side that can be positioned just below the waistband of the garment 2 (FIG. 2), or can form part of the top waist 4 of the garment 2 (FIG. 3) or behind the waistband of the garment 2. Thus, in the closed position, the flap 20 is part of the continuous waist of the garment 2. Thus, the sides 22, 26 extend from the top waist of the garment 2, vertically downward to just below the genitalia area.

The flap 20 is releasably engaged to the garment along the two sides 22, 26 by a respective engagement device 30, to form a front opening 10 in the garment. The flap 20 is releasably engaged to the waistband or just below the waistband 4, and defined by two sides 22, 26 and a bottom side 24. The flap 20, freely lifts to expose the front opening 10, whether the front opening 10, is in the opened or closed position. The opening 10 has two sides and a bottom or bottom side. The first and second sides of the opening are defined by first and second side portion edges 12, 16 of the garment 2 and the bottom is defined by a bottom portion, bottom side or bottom edge 14 of the garment. The flap 20 fits over the opening 10. The flap 20 is attached to the garment portion sides 12, 16 by a respective engagement device 30. The engagement device 30 can extend along the entire garment side 12, 16 and flap sides 22, 26 from the top end of those sides to the bottom end of those sides and can be, for example, a zipper 36, 38 (FIGS. 2, 3) or hook and loop (e.g., VELCRO®) strip(s) 37, 39 (FIGS. 4, 5), each having pulls or pull rings 32, 34. The flap 20 can be attached to the garment bottom portion 14 by a seam or can be integral with or part of the pants. The zippers 36, 38 extend substantially vertically on the pants 2 and move up/down in the embodiment shown, though other opening devices can be provided other than zippers or hook and loop fasteners.

The pulls 32, 34 are used to open the zippers 36, 38 by pulling the zippers 36, 38 down to open the zippers and release the flap 20. The hook and fastener strip(s) 37, 39 also extend substantially vertically on the pants 2 and the flap is pulled down by the pulls 32, 34 to disconnect the hook and loop strips 37, 39. In the open position (FIGS. 4, 5), the flap 20 falls downward and rests along the garment bottom portion 14 and the flap bottom portion 24. In that position, the opening 10 is fully accessible and the male genitalia are exposed. The male genitalia can then be accessed through the opening. The zippers 36, 38 and hook and loop strip(s) 37, 39 can be separately controlled, as shown, or can be interconnected with each other, such as by a string or cord. The flap 20 provides a much larger opening 10 so that the wearer, caregiver, examiner can easily expedite access. However, the opening 10 is not so large that it would disrupt the grip that the garment 2 has on the user's waist or that the garment 2 might otherwise fall down.

The zippers 36, 38 are zipped up by pulling upward on the zipper pulls 32, 34 to refasten the flap 20 in place so the flap 10 is in an upright position. The hook and loop strip(s) 37, 39 are sealed by pressing them together so the flap is in an upright position. The opening 10 is closed and inaccessible, so that the genitals are not exposed. In the closed position (FIGS. 2, 3), the top edge of the flap 20 forms a continuous edge with the waist of the garment. And the opening 10 is closed and inaccessible, so that the male genitalia are not exposed. The flap 20 is a cloth that is the same material as the pants. However, the flap 20 can be different material. In addition, though the cloth is shown as being substantially rectangular or square in shape, it can have any suitable shape.

In addition, the flap 20 originates at the top of the pants and the top of the flap can be located just below the garment waistband 4 (FIG. 2) or can forms the top portion of the pants (FIG. 3) to be linear with the rest of the top of the pants. However, the flap 20 can be located at other areas of the pants as may be suitable, and a zipper or other openable fastener can be positioned along the top of the flap 20, if necessary. The flap 20 can be sold as part of the pants, or can be sold as a separate member with zippers or hook and loop strip(s) that can be readily sewn to an existing pair of pants at which an opening is cut or formed.

Figure 6:
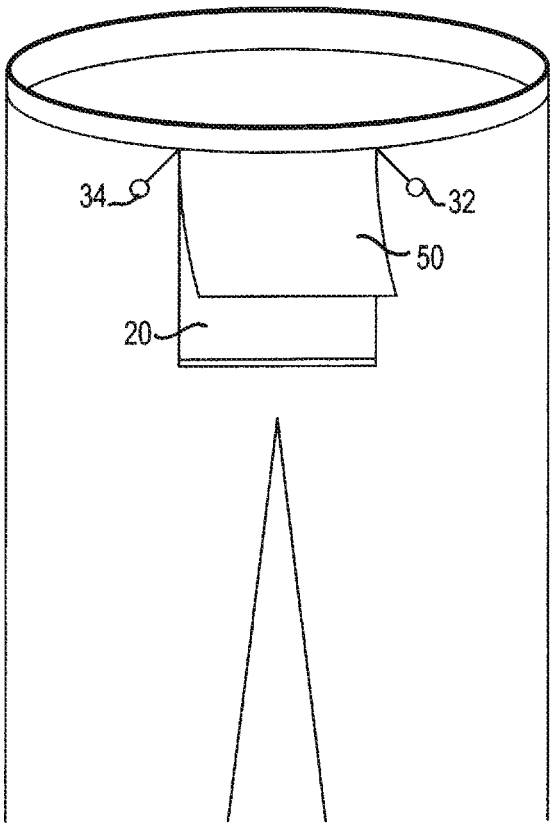
FIG. 6 is a front view of a front flap-opening in the closed position with an extended cover from the waistband.

FIG. 6 illustrates another example embodiment of the invention. Here, the top of the flap is coupled with or connected to the waistband or top portion of the garment, and the bottom of the flap is free. In this embodiment, the closed position of the flap is achieved by moving the zippers downward. And the open position of the flap is achieved by moving the zippers upward and raising the flap upward to reveal the opening and expose the male genitalia.

As shown and described, the flap 20 is located at the front portion of the garment 2, and particularly at the top center of the front portion. The opening 10 defines a right front portion of the garment 2 that includes the first side 12, and a left front portion of the garment 2 that includes the second side 16. The edge of the first and second sides 12, 16 have a first fastening member, such as a first set of zipper teeth or VELCRO® strip(s), and the edge of the first and second sides 22, 26 of the flap 20 have a second fastening member, such as a second set of zipper teeth or VELCRO® strip(s) that matingly engages with the first set of zipper teeth or VELCRO® strip(s).

And as further shown and described, the flap 20 extends from the left front portion to the right front portion. And in one embodiment, the first side 22 of the flap can extend substantially to the center of the left front portion, where the left front portion is aligned with the left leg portion of the garment and the center of the left front portion substantially corresponds to the central longitudinal axis of the left leg. And, the second side 26 of the flap 20 can extend substantially to the center of the right front portion, where the right front portion is aligned with the right leg portion of the garment 2 and the center of the right front portion substantially corresponds to the central longitudinal axis of the right leg portion. And the center of the flap 20 extends along the central longitudinal axis of the garment, substantially where the right and left leg portions meet.

FIG. 6 illustrates another example embodiment of the invention. Here the flap 20 extends from below the waistband (so that the pants don't fall down when the flap 20 is pulled down) and extends to fully or partially cover the opening. The top portion of the flap 20 is free, and the bottom edge is coupled to the garment. In this embodiment, hook and loop fasteners are used, so that the flap 20 is closed by sealing the hook and loop fasteners together. The flap 20 is opened by pulling the pulls 32, 34 downward, which unseals the hook and loop fasteners as the flap 20 is pulled downward to reveal the opening and expose the genitals.

As further shown in FIG. 6, a cover 50 is provided over the flap 20. The cover 50 has a top edge, bottom edge, and left and right side edges. The top edge is sealed at the waistband and the three other edges are free. The cover 50 can be, for example, a rectangular shaped fabric or cover flap that extends at least partly over the flap 20. The cover 50 can be the same size as the flap 20, or can be smaller or larger than the flap 20. The cover 50 can be integrally formed with the garment fabric, and the flap 20 can also be integrally formed with the garment fabric.

The cover 50 prevents inadvertent exposure of the male genitals, and provides additional cover to any openings left uncovered by the flap 20 in the closed position. The cover 50 has an opened position in which it is raised upward, and a closed position in which it hangs downward over the flap 20. Accordingly, in operation, the user can lift the cover 50 to reveal the flap 20. The flap 20 can then be pulled down by use of the pulls 32, 34. Alternatively, the user can pull the flap 20 down without raising the cover 50 since the loops 32, 34 extend outward to the sides of the flap 20. In one embodiment, the pulls 32, 34 can be attached to a small fabric tab member that extends outward to the sides transversely, so that the pulls 32, 34 extend outward from behind the cover 50. The pulls 32, 34 are also located at or near the free side end of the flap 20 or cover 50 to which they are attached.

Thus, the invention includes a U-shaped front-opening, in place of a conventional slit within the seam, on a pair of pajama pants that is fastened on both vertical sides by zippers, VELCRO®, or magnetic buttons or fasteners. It may also be fastened by a continuous bi-directional zipper that traverses the U-shaped opening. The U-shaped opening begins at the waistband or immediately below the waistband and extends to just above the crotch. It falls downward when unfastened. The flap is fully or partially covered by an overlying extension from the waistband.

The invention has a number of benefits. For example, it allows easy access to the male genital for urination during clinical conditions of urinary urgency or urinary incontinence. It also allows ease of access for individuals with impaired hand co-ordination and for caregivers. It facilitates urine collection for clinical purposes for males. And it allows a wider opening for access to the male genitalia than conventional pants opening. It also allows the dignity and pride of wearing clothing rather than a medical gown, and allows free hand use to the patient or individual because of the downward direction of fall of the opened flap. It enables quick access to the male genitalia, easy opening and closure of the opening, and easy access to the male genital for clinical purposes without having to remove clothing.

One purpose of the invention is to provide clothing or pants, and especially pajama wear, with easy and quick access to the male genitalia under conditions of urinary urgency or urinary incontinence. The invention provides easy manipulation of the opening for those patients with impaired hand co-ordination and for caregivers. It provides an alternative access for catheter insertion, use, care and removal without removal of the pants. It also provides an alternative access for inspection of the genital area that does not require removal of the pants.

The invention is designed to have a U-shaped front-opening that starts immediately below the waistband and ends just above the crotch area. It may also start at the waist area and end just above the crotch. Each vertical side can be fastened by zippers, VELCRO® or magnetic fasteners. Ease of manipulation will be provided by pull rings at the top of the flap on the fasteners. Individuals will take hold of the fasteners by grabbing or using a finger to pull on the ring. By pulling on both fasteners, the flap will quickly and easily be released. Both fasteners may be simultaneously engaged with one pull by connecting the pull rings or fasteners with a sewing closure or cord or similar.

In certain embodiments of the invention, the opening may also be fastened by a single zipper with dual direction that traverses the entire U-shape of the opening. Both heads of the zipper will have a ring attached for ease of gripping and pull. A VELCRO® or magnetic fastener can also be utilized allow opening of the flap with a one-hand pull and will also have rings attached for ease of gripping and pull. No buttons, hooks, grips, clasps or snaps are utilized as fasteners. The invention has a lining composed of athletic fabric which may or may not be removable. The front-opening flap can also have two layers of fabric to be formed to have a pocket with an opening to serve as a holder for digital devices and other small items. The invention maintains dignity and pride in individuals and patients who prefer to not be encumbered by medical gowns. The invention can be made from market branded sleepwear fabric comprising of but not limited to cotton, flannel and cotton blend, and would be available in different sizes.

The description given of the embodiments, use, operation, implementation, material, design and construction indicated invention is not limited to what has been stated. What has been stated is simply illustrative.

It is further noted that the description uses several geometric or relational terms and directional or positioning terms, such as linear, vertical, parallel, orthogonal, top, bottom, and sides. Those terms are merely for convenience to facilitate the description based on the embodiments shown in the figures. Those terms are not intended to limit the invention. Thus, it should be recognized that the invention can be described in other ways without those geometric, relational, directional or positioning terms. In addition, the geometric or relational terms may not be exact. For instance, walls may not be exactly perpendicular or parallel to one another but still be considered to be substantially perpendicular or parallel because of, for example, roughness of surfaces, tolerances allowed in manufacturing, etc. And, other suitable geometries and relationships can be provided without departing from the spirit and scope of the invention.

In one example embodiment of the invention for adult pants, the flap 20 can have a length of about 9 inches and a width of about 10 inches and the cover 50 (if provided) can have a length of about 10 inches and a width of about 11 inches, so that the cover 50 is slightly larger than the flap 20 and extends beyond the sides, bottom and top of the flap 20. In another example embodiment of the invention, the cover 50 can have a length of about 3 inches and a width of about 11 inches. In addition, the top edge of the cover 50 can be about 1-2 inches below the waistband, and the top edge of the flap 20 just below that (either with or without the cover 50). Size will vary with population averages similar to a clothing chart size. The flap 20 can optionally have an inner absorbent layer. These pants will benefit all age ranges. Pediatric patients with clinical and physical/mental conditions to adults with similar conditions. Of course, the invention is not limited to any particular size or dimension, and any suitable sizes and dimensions can be utilized within the spirit and scope of the invention.

In addition, while the invention has been discussed with respect to pants and pajamas and being located on the front of the garment, other suitable garments and garment types can incorporate the invention. And, the opening and flap can be provided in other locations on the garment, not just the front. For example, the opening and flap can be located at the rear of the garment to expose the derriere or buttocks. The rear flap can be approximately 13 inches in length and 9.5 inches in width, for an adult, and attach at the bottom of the waistband. Once the rear flap is raised, it can be tucked into the flap or held upward, if needed. And a garment can have both a rear flap and a front flap, or can have just a rear flap or just a front flap. The rear flap supports patients with physical challenges in using a standard commode or performing related sanitary functions. This access would also serve a dual function for females in using the commode. For caregivers, it lessens the challenge of assisting the patient in using the commode and decreases the physical stress of aiding a patient or loved one. Single front access, single rear access or dual access, all claims would apply within gender and also across all ages. In addition, more than one opening and flap can be provided in a single garment, such as one at the front and one at the rear.

Within this specification, the various sizes, shapes and dimensions are approximate and exemplary to illustrate the scope of the invention and are not limiting. The sizes and the terms "substantially" and "about" mean plus or minus 15-20%, more preferably plus or minus 10%, even more preferably plus or minus 5%, most preferably plus or minus 1-2%. In addition, while specific dimensions, sizes and shapes may be provided in certain embodiments of the invention, those are simply to illustrate the scope of the invention and are not limiting. Thus, other dimensions, sizes and/or shapes can be utilized without departing from the spirit and scope of the invention.

Thus, in a first embodiment, the disclosure provides pajama pants sleepwear comprising: an upper circumferential edge defining an open waist; a front half formed of flannel or cotton pajama sleepwear fabric material; an opening formed in a front portion of the front half, the front portion being substantially smaller than the front half, the opening defining a left front portion with a vertical left front portion side edge extending vertically downward directly from said upper circumferential edge, a right front portion with a right front portion side edge extending vertically downward directly from said upper circumferential edge, and a bottom portion with a horizontal bottom front portion side edge; a flap having a square or rectangular shape with a first flap side edge, a second flap side edge opposite the first flap side edge, a top flap side edge, and a bottom flap side edge, said top flap side edge aligned with and forming a portion of said upper circumferential edge, said flap formed of flannel or cotton pajama sleepwear fabric material; a first engagement device releasably coupling the left front portion side edge and the first flap side edge; and a second engagement device separate from said first engagement device, said second engagement device releasably coupling the right front portion side edge and the second flap side edge.

A second embodiment includes the pajama pants sleepwear of the first embodiment, wherein the bottom flap side edge has a length defining a width for said flap of about 11 inches. A third embodiment includes the pajama pants sleepwear of the first embodiment, wherein the bottom flap side edge extends from the left front portion to the right front portion of said front portion. A fourth embodiment includes the pajama pants sleepwear of the first embodiment, wherein said flap has an open position in which the first and second engagement devices are open and said flap folds down along the bottom flap side edge. A fifth embodiment includes the pajama pants sleepwear of the first embodiment, wherein said flap has a closed position in which the first and second engagement devices are closed and said top flap side edge extends substantially continuously with the upper circumferential edge of said pants. A sixth embodiment includes the pajama pants sleepwear of the fifth embodiment, wherein in the closed position said top flap side edge is behind a waist band of said pants. A seventh embodiment includes the pajama pants sleepwear of the first embodiment, wherein said flap has a closed position in which the first and second engagement devices are closed and said top flap side edge extends just below a waist band of said pants. An eighth embodiment includes the pajama pants sleepwear of the first embodiment, wherein the bottom flap side edge is integrally coupled with the bottom front portion side edge. A ninth embodiment includes the pajama pants sleepwear of the first embodiment, further comprising a coupling device engaged with the first and second engagement devices for simultaneously uncoupling the left and right front portion side edges and the first and second flap side edges, respectively. A tenth embodiment includes the pajama pants sleepwear of the first embodiment, wherein the opening and flap are aligned with male genitalia. An eleventh embodiment includes the pajama pants sleepwear of the first embodiment, further comprising a cover extending directly and at least partly over said flap in a closed position, said cover having a square or rectangular shape with a first cover side edge, a second cover side edge, a cover top edge and a cover bottom edge, and wherein the cover top edge is fixedly coupled just below a waistband of the pants and the cover bottom edge and first and second side edges are free so that in the closed position said cover hangs freely at least partly over said flap and in an open position said cover opens upward to reveal said flap, and said flap opens downward.

A twelfth embodiment is provided having pajama pants sleepwear comprising: an upper circumferential edge defining an open waist, a front half having a front portion with an opening defining a left front portion with a left front portion side edge, a right front portion with a right front portion side edge, and a bottom portion with a bottom front portion side edge; a flap having a square or rectangular shape with a first flap side edge extending vertically downward from said upper circumferential edge, a second flap side edge opposite the first flap side edge and extending vertically downward from said upper circumferential edge, a top flap side edge, and a bottom flap side edge, the bottom flap side edge coupled with the bottom front portion side edge, an engagement device for releasably coupling the left front portion side edge and the first flap side edge, and releasably coupling the right front portion side edge and the second flap side edge; and a cover extending directly over said flap in a closed position and disconnected from said flap in both the closed position and an open position, said cover having a square or rectangular shape with a first cover side edge, a second cover side edge, a cover top edge and a cover bottom edge, and wherein the cover top edge is fixedly coupled to the front half just below a waistband of the pants and the cover bottom edge and first and second side edges are free so that in the closed position said cover hangs freely over said flap and in the open position said cover opens upward to reveal said flap and said flap opens downward.

A thirteenth embodiment includes the pajama pants sleepwear of the twelfth embodiment, wherein the bottom flap side edge has a length defining a width for said flap of about 11 inches. A fourteenth embodiment includes the pajama pants sleepwear of twelfth embodiment, wherein the bottom flap side edge extends from the left front portion to the right front portion of said front portion. A fifteenth embodiment includes the pajama pants sleepwear of the twelfth embodiment, wherein said flap has an open position in which the first and second engagement devices are open and said flap folds down along the bottom flap side edge. A sixteenth embodiment includes the pajama pants sleepwear of the twelfth embodiment, wherein said flap has a closed position in which the first and second engagement devices are closed and said top flap side edge extends substantially continuously with the upper circumferential edge of said pants. A seventeenth embodiment includes the pajama pants sleepwear of the fifteenth embodiment, wherein in the closed position said top flap side edge is behind a waist band of said pants. An eighteenth embodiment includes the pajama pants sleepwear of the twelfth embodiment, wherein said flap has a closed position in which the first and second engagement devices are closed and said top flap side edge extends just below a waist band of said pants.

A nineteenth embodiment includes pajama pants sleepwear comprising: an upper circumferential edge defining an open waist; a rear half; an opening formed in a rear portion of the rear half, the rear portion being substantially smaller than the rear half, the opening defining a left rear portion with a vertical left rear portion side edge, a right rear portion with a vertical right rear portion side edge, and a bottom portion with a horizontal bottom rear portion side edge; a flap having a square or rectangular shape with a first flap side edge extending vertically downward directly from said upper circumferential edge, a second flap side edge opposite the first flap side edge and extending vertically downward directly from said upper circumferential edge, a top flap side edge, and a bottom flap side edge, the bottom flap side edge coupled with the bottom rear portion side edge, said top flap side edge aligned with and forming a portion of said upper circumferential edge; a first engagement device releasably coupling the left rear portion side edge and the first flap side edge; and a second engagement device separate from the first engagement device, said second engagement device releasably coupling the right rear portion side edge and the second flap side edge; and a cover having a closed position and an open position, said cover extending directly over said flap in said closed position and revealing said flap in the open position, said cover having a square or rectangular shape with a first cover side edge, a second cover side edge, a cover top edge and a cover bottom edge, and wherein the cover top edge is integrally coupled to the rear half just below a waistband of the pants and is disconnected from the flap, and the cover bottom edge and first and second side edges are free so that said cover hangs freely over said flap in the closed position and opens upward in the open position to reveal said flap and said flap opens downward.

A twentieth embodiment includes the pajama pants sleepwear of the first embodiment, wherein the front half and flap are formed of flannel sleepwear material. A twenty-first embodiment includes the pajama pants sleepwear of the eleventh embodiment, wherein said flap has a flap width and said cover has a cover width, wherein said cover width is larger than said flap width and said cover covers the entire flap width in the closed position.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. Pajama pants sleepwear comprising:

an upper circumferential edge defining an open waist at a waistband of the pajama pants sleepwear;

a front half formed of flannel or cotton pajama sleepwear fabric material;

an opening formed in a front portion of the front half, the front portion being substantially smaller than the front half, the opening defining a left front portion with a vertical left front portion side edge extending vertically downward directly from said upper circumferential edge, a right front portion with a right front portion side edge extending vertically downward directly from said upper circumferential edge, and a bottom portion with a horizontal bottom front portion side edge;

a flap having a square or rectangular shape with a first flap side edge, a second flap side edge opposite the first flap side edge, a top flap side edge, and a bottom flap side edge, said top flap side edge aligned with and forming a portion of said upper circumferential edge, said flap formed of flannel or cotton pajama sleepwear fabric material;

a first engagement device releasably coupling the left front portion side edge and the first flap side edge;

a second engagement device separate from said first engagement device, said second engagement device releasably coupling the right front portion side edge and the second flap side edge; and a cover extending directly and at least partly over said flap in a closed position, said cover having a square or rectangular shape with a first cover side edge, a second cover side edge, a cover top edge and a cover bottom edge, and wherein the cover top edge is fixedly coupled at the waistband of the pajama pants sleepwear and the cover bottom edge and the first and second cover side edges are free so that in the closed position said cover hangs freely at least partly over said flap and in an open position said cover moves upward to reveal said flap, and said flap moves downward, and wherein said top flap side edge is free and folds downward along the bottom flap side edge.

2. The pajama pants sleepwear of claim 1, wherein the bottom flap side edge has a length defining a width for said flap of about 11 inches.

3. The pajama pants sleepwear of claim 1, wherein the bottom flap side edge extends from the left front portion to the right front portion of said front portion.

4. The pajama pants sleepwear of claim 1, wherein said flap has an open position in which the first and second engagement devices are uncoupled and said flap folds down along the bottom flap side edge.

5. The pajama pants sleepwear of claim 1, wherein said flap has a closed position in which the first and second engagement devices are closed and said top flap side edge extends substantially continuously with the upper circumferential edge of said pajama pants sleepwear.

6. The pajama pants sleepwear of claim 5, wherein in the closed position said top flap side edge is behind the waistband of said pajama pants sleepwear.

7. The pajama pants sleepwear of claim 1, wherein said flap has a closed position in which the first and second engagement devices are closed and said top flap side edge extends just below the waistband of said pajama pants sleepwear.

8. The pajama pants sleepwear of claim 1, wherein the bottom flap side edge is permanently coupled with the bottom front portion side edge.

9. The pajama pants sleepwear of claim 1, further comprising a coupling device engaged with the first and second engagement devices for simultaneously uncoupling the left and right front portion side edges and the first and second flap side edges, respectively.

10. The pajama pants sleepwear of claim 1, wherein the opening and the flap are configured to align with male genitalia.

11. The pajama pants sleepwear of claim 1, wherein the front half and the flap are formed of flannel sleepwear fabric material.

12. The pajama pants sleepwear of claim 1, wherein the flap has a flap width and the cover has a cover width, wherein the cover width is larger than the flap width and the cover covers the entire flap width in the closed position.

13. Pajama pants comprising:

an upper circumferential edge defining an open waist at a waistband of the pajama pants;

a front half having a front portion with an opening defining a left front portion with a left front portion side edge, a right front portion with a right front portion side edge, and a bottom portion with a bottom front portion side edge, said front half made of pajama sleepwear material;

an inner flap having a square or rectangular shape with a first flap side edge extending vertically downward from said upper circumferential edge, a second flap side edge opposite the first flap side edge and extending vertically downward from said upper circumferential edge, a top flap side edge, and a bottom flap side edge, the bottom flap side edge coupled with the bottom front portion side edge, said inner flap made of pajama sleepwear material;

a first engagement device releasably coupling the left front portion side edge and the first flap side edge, and a second engagement device releasably coupling the right front portion side edge and the second flap side edge; and an outer cover configured to extend directly over said inner flap in a closed position and disconnected from said inner flap in both the closed position and an open position, said outer cover having a square or rectangular shape with a first cover side edge, a second cover side edge, a cover top edge and a cover bottom edge, and wherein the cover top edge is fixedly coupled to the front half at the waistband of the pajama pants and the cover bottom edge and the first and second cover side edges are free so that in the closed position said outer cover hangs freely over said inner flap and in the open position said outer cover moves upward to reveal said inner flap and said inner flap moves downward, said outer cover made of pajama sleepwear material, whereby the pajama sleepwear material of said front half, said inner flap and said outer cover are a same pajama sleepwear material forming said pajama pants.

14. The pajama pants of claim 13, wherein the bottom flap side edge has a length for said inner flap of about 11 inches.

15. The pajama pants of claim 13, wherein the bottom flap side edge extends from the left front portion to the right front portion of said front portion.

16. The pajama pants of claim 13, wherein said inner flap has an open position in which the first and second engagement device is uncoupled and said inner flap is configured to fold down along the bottom flap side edge.

17. The pajama pants of claim 13, wherein said inner flap has a closed position in which the first and second engagement device is closed and said top flap side edge extends substantially continuously with the upper circumferential edge of said pajama pants.

18. The pajama pants of claim 17, wherein in the closed position said top flap side edge is behind the waistband of said pajama pants.

19. The pajama pants of claim 13, wherein said inner flap has a closed position in which the first and second engagement device is closed and said top flap side edge extends just below the waistband of said pajama pants.

20. The pajama pants sleepwear of claim 13, wherein the front half, the flap and the cover are made of pajama flannel sleepwear material.

21. Pajama pants sleepwear comprising:

an upper circumferential edge defining an open waist at a waistband of the pajama pants sleepwear;

a rear half;

an opening formed in a portion of the rear half, the portion being substantially smaller than the rear half, the opening defining a left rear portion with a vertical left rear portion side edge, a right rear portion with a vertical right rear portion side edge, and a bottom portion with a horizontal bottom rear portion side edge;

a flap having a square or rectangular shape with a first flap side edge extending vertically downward directly from said upper circumferential edge, a second flap side edge opposite the first flap side edge and extending vertically downward directly from said upper circumferential edge, a top flap side edge, and a bottom flap side edge, the bottom flap side edge coupled with the bottom rear portion side edge, said top flap side edge aligned with and forming a portion of said upper circumferential edge, said flap made of pajama sleepwear material;

a first engagement device positioned along the left rear portion side edge and the first flap side edge to releasably couple the left rear portion side edge and the first flap side edge; and a second engagement device separate from the first engagement device, said second engagement device positioned along the right rear portion side edge and the second flap side edge to releasably couple the right rear portion side edge and the second flap side edge; and a cover having a closed position and an open position, said cover extending directly over said flap in said closed position and revealing said flap in the open position, said cover having a square or rectangular shape with a first cover side edge, a second cover side edge, a cover top edge and a cover bottom edge, and wherein the cover top edge is integrally coupled to the rear half at the waistband of the pajama pants sleepwear and is disconnected from the flap, and the cover bottom edge and first and second side edges are free so that said cover hangs freely over said flap in the closed position and moves upward in the open position to reveal said flap and said flap moves downward, said cover made of pajama sleepwear material, and wherein said top flap side edge is free and folds downward along the bottom flap side edge.

22. The pajama pants sleepwear of claim 21, wherein the flap and the cover are made of flannel pajama sleepwear material.

* * * * *